US012024950B2

(12) United States Patent
Keskiniva et al.

(10) Patent No.: US 12,024,950 B2
(45) Date of Patent: Jul. 2, 2024

(54) FLUSHING AND CONNECTION ARRANGEMENTS FOR PERCUSSION DRILL TOOLS

(71) Applicant: Mincon International Limited, Shannon (IE)

(72) Inventors: Markku Keskiniva, Ylinen (FI); Ben Sexton, Limerick (IE)

(73) Assignee: MINCON INTERNATIONAL LIMITED, Shannon (IE)

( * ) Notice: Subject to any disclaimer, the term of this patent is extended or adjusted under 35 U.S.C. 154(b) by 0 days.

(21) Appl. No.: 17/914,945

(22) PCT Filed: Mar. 25, 2021

(86) PCT No.: PCT/EP2021/057827

§ 371 (c)(1),
(2) Date: Sep. 27, 2022

(87) PCT Pub. No.: WO2021/198038

PCT Pub. Date: Oct. 7, 2021

(65) Prior Publication Data

US 2023/0151694 A1 May 18, 2023

(30) Foreign Application Priority Data

Mar. 30, 2020 (IE) ..... 2020/0053
Oct. 28, 2020 (IE) ..... 2020/0239

(51) Int. Cl.
*E21B 1/30* (2006.01)
*E21B 1/38* (2006.01)
*E21B 10/36* (2006.01)

(52) U.S. Cl.
CPC ..... *E21B 1/30* (2020.05); *E21B 1/38* (2020.05); *E21B 10/36* (2013.01)

(58) Field of Classification Search
CPC ... E21B 1/30; E21B 1/38; E21B 10/36; E21B 4/14; E21B 10/38
See application file for complete search history.

(56) References Cited

U.S. PATENT DOCUMENTS 2,461,530 A 2/1949 Curtis et al.
3,981,540 A * 9/1976 Hawkes ..... E21D 9/104 299/62

(Continued)

FOREIGN PATENT DOCUMENTS

WO WO-2019/092600 A1 5/2019

OTHER PUBLICATIONS

International Search Report from corresponding International Patent Application No. PCT/EP2021/057827 dated Aug. 20, 2021.

(Continued)

*Primary Examiner* — Tara Schimpf
*Assistant Examiner* — Jennifer A Railey
(74) *Attorney, Agent, or Firm* — KUSNER & JAFFE

(57) ABSTRACT

The present invention relates to a fluid-operated percussion drill tool comprising an outer wear sleeve comprising a substantially cylindrical wall and having inner and outer surfaces. The tool also comprises a percussion bit having a head portion and a bit retaining portion and located at a forward end of the outer wear sleeve. The tool further comprises a sliding piston mounted for reciprocating movement within the outer wear sleeve to strike the percussion bit. The tool also includes a drive ring having a substantially cylindrical wall and comprising connection means adapted for connecting the drive ring to a drive means of the fluid-operated percussion drill tool. At least one flushing channel provides a fluid path to the cutting face of the bit for a flushing medium. A first portion of the at least one flushing channel extends longitudinally within the wall of the wear (Continued)

sleeve, a second portion of the at least one flushing channel extends longitudinally within the wall of the drive ring and a third portion of the at least one flushing channel extends through the head portion of the percussion bit to the cutting face of the bit.

26 Claims, 13 Drawing Sheets

(56) References Cited

U.S. PATENT DOCUMENTS

| | | | | |
|---|---|---|---|---|
| 4,765,418 | A * | 8/1988 | Ennis | E21B 4/14 175/321 |
| 4,819,746 | A * | 4/1989 | Brown | E21B 44/005 175/215 |
| 6,702,045 | B1 * | 3/2004 | Elsby | E21B 4/14 175/93 |
| 2013/0327576 | A1 | 12/2013 | Gien | |

OTHER PUBLICATIONS

Written Opinion from corresponding International Patent Application No. PCT/EP2021/057827 dated Aug. 20, 2021.
International Preliminary Report on Patentability from corresponding International Patent Application No. PCT/EP2021/057827 dated Jun. 8, 2022.

* cited by examiner

FLUSHING AND CONNECTION ARRANGEMENTS FOR PERCUSSION DRILL TOOLS

FIELD OF THE INVENTION

The present invention relates to flushing and connection arrangements for fluid-operated percussion drill tools. In particular, the invention concerns flushing and connection arrangements for use in down-the-hole hammers.

BACKGROUND TO THE INVENTION

Percussion bits for fluid-operated percussion drill tools, such as down-the-hole hammers, typically comprise a bit head, populated with cutting inserts on the front face of the head. The bit head is formed with an axially extending shank having a smaller diameter than the bit head. As the hammer rotates, rotational drive is most commonly transmitted to the shank by way of splines provided on the external cylindrical wall of the shank which mate with splines provided internally of a drive chuck of the drill tool. During the drilling cycle, an impact piston collides with a rear end of the shank, forcing the cutting inserts on the bit head into the rock being drilled. Pressurised air, known as flushing air, is used to flush cuttings out of the hole while the hammer operates. Flushing air may be provided via a flushing bore through the centre of the piston and a corresponding bore through the bit shank. However, this arrangement typically requires a footvalve, which can be prone to breakage, to control the flushing air. Furthermore, the strike area of the piston is reduced due to the central bore, which also reduces the weight of the piston. The area of the lifting surface of the piston is also reduced. An alternative is to have the flushing air travel along the splines, with channels provided in the bit head to direct the air from the splines to the cutting face of the bit. As the splines require lubrication, lubricating oil may be added to the flushing air stream at the drill rig.

Irish Patent No. S87042 proposes an alternative arrangement to the conventional splined engagement between the drive means of the drill tool and the bit, in which a drive ring is provided with a plurality of protrusions at a forward end therefore, each of which is received in one of a corresponding plurality of recesses on the bit head. Because the engagement means are provided at the head portion of the bit, the length of the bit may be reduced, thereby reducing the overall weight of the bit, enabling faster and more efficient drilling. It is desirable to provide a flushing arrangement for use with this drive mechanism, and others, that allows for increased piston weight and strike area and that optimises the piston to bit mass ratio.

SUMMARY OF THE INVENTION

According to the present invention, there is provided a fluid-operated percussion drill tool comprising:

- an outer wear sleeve comprising a substantially cylindrical wall and having inner and outer surfaces;
- a percussion bit having a head portion and a bit retaining portion and located at a forward end of the outer wear sleeve;
- a sliding piston mounted for reciprocating movement within the outer wear sleeve to strike the percussion bit;
- a drive ring having a substantially cylindrical wall and comprising connection means adapted for connecting the drive ring to a drive means of the fluid-operated percussion drill tool;

- at least one flushing channel to provide a fluid path to the cutting face of the bit for a flushing medium, characterised in that a first portion of the at least one flushing channel extends longitudinally within the wall of the wear sleeve, a second portion of the at least one flushing channel extends longitudinally within the wall of the drive ring and a third portion of the at least one flushing channel extends through the head portion of the percussion bit to the cutting face of the bit.

The first portion of the or each flushing channel is internal to the substantially cylindrical wall of the outer wear sleeve. That is, it is disposed within and extends longitudinally through the wall of the wear sleeve rather than being disposed within an inner surface of the wear sleeve itself. Thus, the first portion of the or each flushing channel extends longitudinally through the wall of the wear sleeve between an inner surface of the wear sleeve and an outer surface of the wear sleeve. Similarly, the second portion of the or each flushing channel is internal to the substantially cylindrical wall of the drive ring. Again, the second portion of the flushing channel is disposed within and extends longitudinally through the wall of the drive ring rather than being disposed within the drive ring itself. Thus, the second portion of the or each flushing channel extends longitudinally through the wall of the drive ring between an inner surface of the drive ring and an outer surface of the drive ring.

The term "forward" as used herein is intended to indicate a direction towards the cutting face of the drill bit. The term "rear" or "rearward" as used herein is intended to indicate a direction away from the cutting face of the drill bit.

This arrangement is advantageous because the requirement for a footvalve and a central flushing bore through the piston is avoided. This allows the piston weight to be maximised and the strike area of the piston to be increased, thereby providing increased driving force and increased piston lifting force. Piston impact is also spread over a larger contact area which may improve longevity of the piston. A further advantage of this arrangement is that the flushing fluid is discharged at the cutting face of the bit.

In an embodiment of the invention, for example, where the fluid-operated percussion drill tool is a pneumatically operated percussion drill tool, the air used to drive the piston may also be used as the flushing medium. In this embodiment, the first portion of the or each flushing channel has a first inlet at an inner surface of the outer wear sleeve and an outlet at a forward end of the wall of the outer wear sleeve. The first inlet may be arranged to exhaust air from a top chamber of the fluid-operated percussion drill tool. The first portion of the or each flushing channel may have a second inlet at an inner surface of the outer wear sleeve, wherein the second inlet is at a different longitudinal position along the wear sleeve than the first inlet. For example, the second inlet may be forward of the first inlet. The second inlet may be arranged to exhaust air from a bottom chamber of the fluid-operated percussion drill.

In another embodiment, for example, where the fluid-operated percussion drill tool is a hydraulically operated percussion drill too, the tool may receive a supply of air for use as a flushing medium. In this embodiment, the first portion of the or each flushing channel has an inlet at an inner surface of the outer wear sleeve and an outlet at a forward end of the wall of the outer wear sleeve. As the flushing air is supplied independently of the drive mechanism of the tool, a second inlet is not required.

The second portion of the or each flushing channel may have an inlet at a rear end of the drive ring and an outlet, wherein the inlet is arranged to receive the flushing medium from the outlet of the first portion of the flushing channel. In some embodiments, the outlet of the second portion of the or each flushing channel may be provided at an inner surface of the drive ring. In some embodiments, the outlet of the second portion of the or each flushing channel may be provided at a forward end of the drive ring.

The third portion of the or each flushing channel may have an inlet at a head portion of the percussion bit and an outlet in a cutting face of the percussion bit, wherein the inlet is arranged to receive the flushing medium from the outlet of the second portion of the flushing channel.

The fluid-operated percussion drill tool may also comprise engagement means on the percussion bit engageable with complementary engagement means on the drive ring whereby rotational drive from the drive ring may be transmitted to the percussion bit.

Preferably, the engagement means are provided on the head portion of the percussion bit. In an embodiment, the engagement means on the head portion of the percussion bit comprises a plurality of recesses and the complementary engagement means on the drive ring comprises a corresponding plurality of protrusions at a forward end thereof, whereby each protrusion is received within a corresponding recess to transmit rotational drive from the drive ring to the percussion bit. In an alternate embodiment, the engagement means on the head portion of the percussion bit comprises a plurality of protrusions and the complementary engagement means on the drive ring comprises a corresponding plurality of recesses, whereby each protrusion is received within a corresponding recess to transmit rotational drive from the drive ring to the percussion bit.

An advantage of this arrangement is that the bit weight is reduced due to the provision of the engagement means on the bit head, allowing the piston to bit mass ratio to be optimised. Furthermore, since the engagement means is provided on the head portion of the bit, a splined shank is no longer required, thereby also removing the requirement for spline lubrication. The shank can also be shortened, or eliminated entirely.

In an embodiment, the second portion of the flushing channel has an outlet in one of the protrusions on the drive ring. The outlet may be provided on an inner surface of the protrusion. Alternatively or additionally, the outlet may be provided at a forward end of the protrusion. A plurality of flushing channels may be provided such that each protrusion on the drive ring has an outlet for flushing medium. In some embodiments, more than one outlet may be provided on each protrusion. The exact location and orientation of the or each outlet may be selected to optimise the exit angle for the flushing fluid to ensure that the flushing fluid is directed effectively.

In another embodiment, the second portion of the flushing channel has an outlet between two adjacent protrusions on the drive ring. The outlet may be provided on an inner surface of the drive ring. Alternatively or additionally, the outlet may be provided at a forward end of drive ring. A plurality of flushing channels may be provided such that an outlet for flushing medium is provided between each pair of adjacent protrusions.

The drive ring may comprise a plurality of separable part-annular drive dog segments. Each drive dog segment may comprise one or more of the plurality of protrusions.

The fluid-operated percussion drill tool may further comprise bit retaining means adapted for engagement with the bit retaining portion of the percussion bit to retain the percussion bit in the drill tool. The bit retaining means may comprise a shoulder formed internally of the drive ring for engagement with the bit retaining portion of the percussion bit to retain the percussion bit in the drill tool. In other embodiments, the bit retaining means may comprise a bit retaining ring. The bit retaining portion of the percussion bit may comprise a retaining shoulder.

The fluid-operated percussion drill tool may further comprise an annular flange arranged around the outer wear sleeve at a forward end thereof. The flange may be restrained from forward movement relative to the wear sleeve by engagement of an internal shoulder provided on the flange with an external shoulder provided at a forward end of the wear sleeve. The connection means of the drive ring may comprise an annular collar provided at a rear end of the drive ring, arranged to receive a forward end of the wear sleeve such that a forward end of the wear sleeve abuts an internal shoulder the drive ring. A plurality of holes may be provided in a rear end of the collar, which may abut a forward end of the flange. The flange may comprise a plurality of through holes provided therein, wherein each through hole corresponds to one of the plurality of holes in the collar, and wherein each through hole and corresponding hole in the collar is configured to receive a fastener, such as a bolt, to connect the drive ring to a drive means of the percussion drill tool. The through holes in the flange and/or the holes in the collar may be internally screw-threaded.

According to another aspect of the present invention, there is provided a fluid-operated percussion drill tool comprising:

- an outer wear sleeve comprising a substantially cylindrical wall and having inner and outer surfaces;
- a percussion bit having a head portion and a bit retaining portion and located at a forward end of the outer wear sleeve;
- a sliding piston mounted for reciprocating movement within the outer wear sleeve to strike the percussion bit;
- a drive ring having a substantially cylindrical wall and comprising connection means adapted for connecting the drive ring to a drive means of the fluid-operated percussion drill tool; and
- an annular flange arranged around the outer wear sleeve at a forward end thereof, wherein the flange comprises a plurality of through holes provided therein and is restrained from forward movement relative to the wear sleeve by engagement of an internal shoulder provided on the flange with an external shoulder provided at a forward end of the wear sleeve; and
- wherein the connection means of the drive ring comprises an annular collar provided at a rear end of the drive ring, the collar comprising a plurality of holes provided in a rear end thereof, wherein each hole corresponds to one of the plurality of through holes in the flange, the collar arranged to receive a forward end of the wear sleeve such that a forward end of the wear sleeve abuts an internal shoulder of the drive ring and the rear end of the collar is arranged to abut a forward end of the flange and wherein each through hole and corresponding hole in the collar is configured to receive a fastener to connect the drive ring to a drive means of the percussion drill tool.

A bit retaining ring may be arranged to engage with the bit retaining portion of the percussion bit to retain the bit in the percussion drill tool. The bit retaining ring may be clamped in place between the drive ring and an aligner by engagement of the fasteners with the drive ring.

The bit retaining ring may be provided as a plurality of part-annular bit retaining portions and the depth of the holes in the collar of the drive ring may be greater than a height of the bit retaining portions such that the percussion bit is removable from the drill tool by withdrawing the fasteners from the holes by a distance greater than or equal to the height of the bit retaining portions but less than the depth of the holes such that when the outer wear sleeve is moved away from the percussion bit, an annular space is formed between the forward end of the wear sleeve and the internal shoulder of the drive ring, into which the bit retaining portions are moveable in a radially outward direction such that they no longer retain the percussion bit in the drill tool.

The fluid-operated percussion drill tool may further comprise an O-ring arranged around the bit retaining portions. Alternatively, the fluid-operated percussion drill tool may comprise a plurality of pins extending through the drive ring and arranged to engage the bit retaining portions.

According to an aspect of the invention, there is provided a method for removing a percussion drill bit from a fluid-operated percussion drill tool as set out above, the method comprising:

- withdrawing the fasteners from the holes by a distance greater than or equal to the height of the bit retaining portions but less than the depth of the holes;
- moving the outer wear sleeve and the drive ring apart relative to one another to create an annular space between the forward end of the wear sleeve and the internal shoulder of the drive ring; and
- moving the drill tool and the percussion drill bit apart relative to one another, such that the bit retaining portion of the percussion bit causes the bit retaining portions of the bit retaining ring to move in a radially outward direction into the annular space.

The method may be further for replacing the percussion drill bit, and may further comprise:

- inserting a percussion bit into the distal end of the percussion drill tool;
- moving the bit retaining portions of the bit retaining ring in a radially inward direction by actuating a plurality of pins extending through the drive ring and arranged to engage the bit retaining portions; and
- moving the outer wear sleeve towards the percussion bit and re-inserting the fasteners in the holes.

According to an aspect of the invention, the fluid-operated percussion drill tool is a down-the-hole hammer.

DETAILED DESCRIPTION OF THE DRAWINGS

Figure 1:
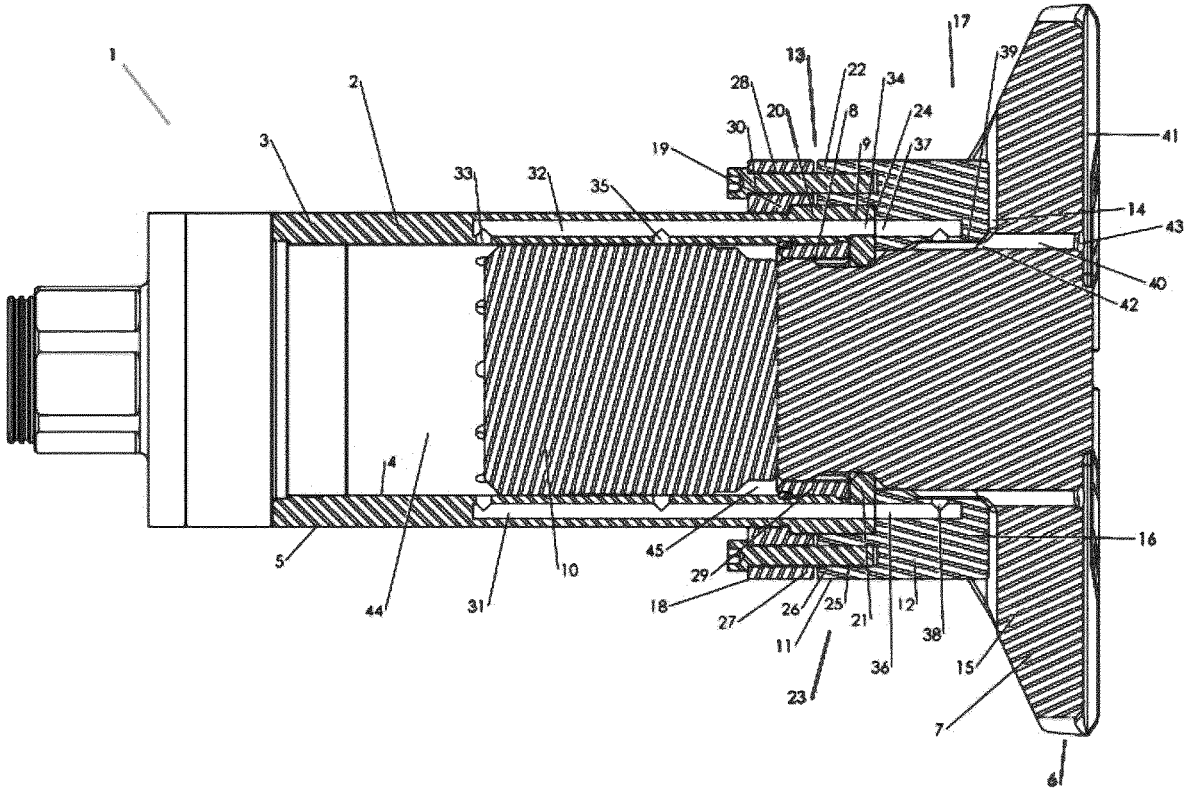
FIG. 1 is a longitudinal cross-section of a down-the-hole hammer according to a first embodiment of the invention.

A down-the-hole hammer 1 according to a first embodiment of the present invention is illustrated in FIGS. 1 to 5. The hammer 1 comprises an outer wear sleeve 2 comprising a substantially cylindrical wall 3 and having inner 4 and outer 5 surfaces. The hammer also comprises a percussion bit 6 having a head portion 7 and a bit retaining shoulder 8. The bit is located at a forward end 9 of the outer wear sleeve. The hammer further comprises a sliding piston 10 mounted for reciprocating movement within the outer wear sleeve to strike the percussion bit. A drive ring 11 having a substantially cylindrical wall 12 comprises connection means 13 adapted for connecting the drive ring to a drive means of the hammer. A bit retaining ring 21 is arranged to engage with the bit retaining shoulder 8 on the percussion bit to retain the bit in the hammer.

Figure 4:
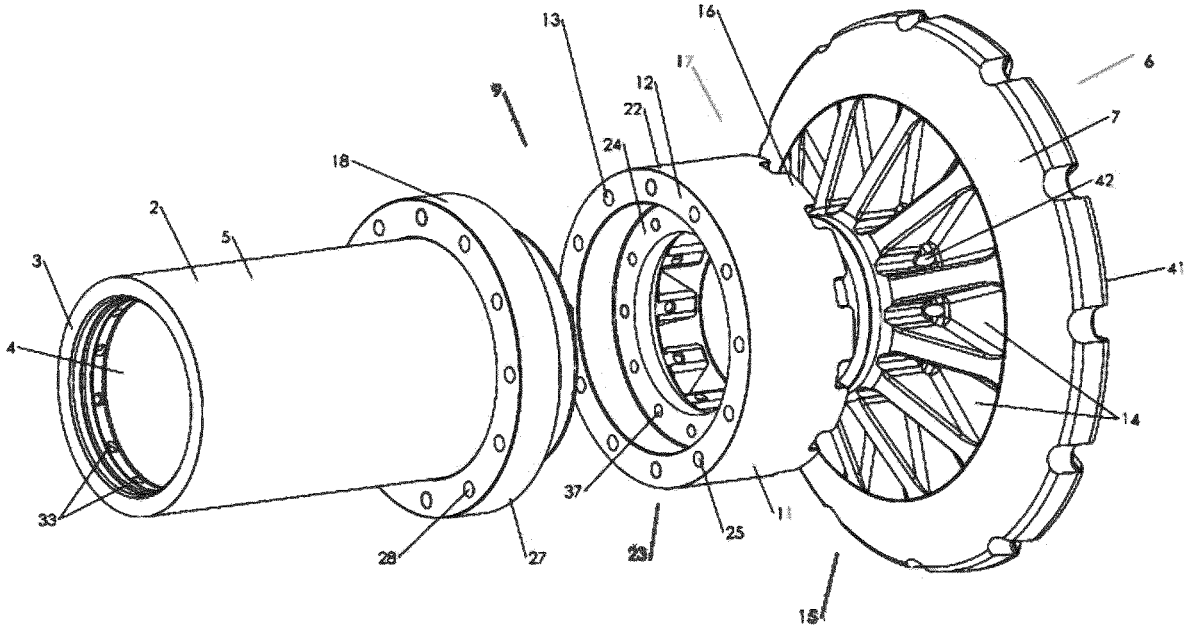
FIG. 4 is an exploded view of some of the components of the hammer of FIG. 1.

As best shown in FIG. 4, a plurality of recesses 14 are provided at a rear end 15 of the head portion 7 of the percussion bit 6. A corresponding plurality of protrusions 16 is provided at a forward end 17 of the drive ring 11. Each protrusion 16 is received within a corresponding recess 14 to transmit rotational drive from the drive ring 11 to the percussion bit 6.

The hammer further comprises an annular flange 18 arranged around the outer wear sleeve at the forward end 9 thereof. The flange is restrained from forward movement relative to the wear sleeve by engagement of an internal shoulder 19 provided on the flange with an external shoulder 20 provided at a forward end of the wear sleeve. The connection means 13 of the drive ring comprises an annular collar 22 provided at a rear end 23 of the drive ring, arranged to receive the forward end 9 of the wear sleeve such that the forward end of the wear sleeve abuts an internal shoulder 24 of the drive ring. A plurality of internally screw-threaded holes 25 are provided in a rear end 26 of the collar, and the rear end of the collar is arranged to abut a forward end 27 of the flange 18. A plurality of through holes 28 are provided in the flange. Each through hole corresponds to one of the plurality of holes in the collar. A bolt 30 is inserted into each through hole 28 and screwed into the corresponding hole 25 in the collar to connect the drive ring to the wear sleeve and thus to the drive means of the percussion drill tool. The clamping effect of this bolted arrangement also holds the bit retaining ring 21 in place between the drive ring 11 and an aligner 29.

Figure 5:
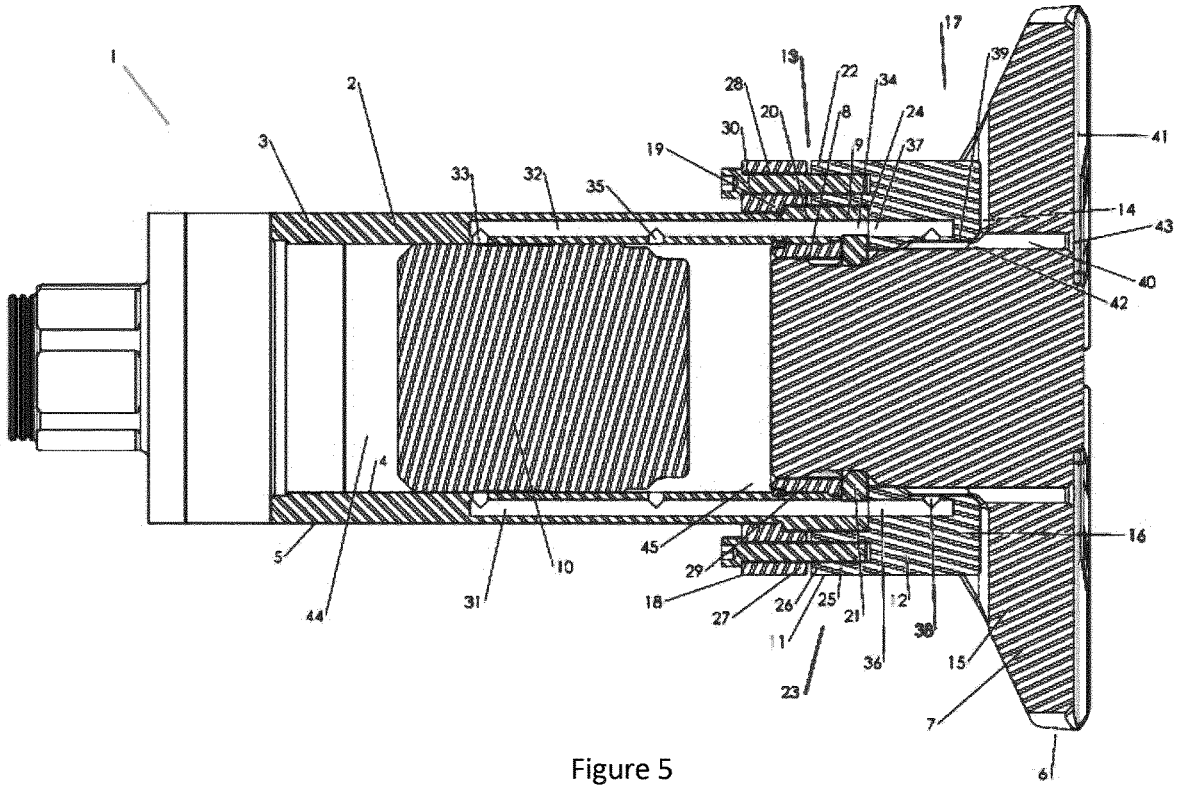
FIG. 5 is a longitudinal cross-section of the down-the-hole hammer of FIG. 1, showing the piston at top of stroke.

As best illustrated in FIG. 1, the hammer 1 comprises a plurality of flushing channels 31 to provide a fluid path for a flushing medium. The flushing channels are provided in a radially spaced apart arrangement around the hammer. A first portion 32 of each flushing channel extends longitudinally within the wall 3 of the wear sleeve 2. As shown in the figures, the first portion 32 of each flushing channel is internal to the wall 3 of the outer wear sleeve meaning that it is disposed within the wall of the wear sleeve rather than being disposed within an inner surface of the wear sleeve itself. The first portion 32 of each flushing channel has a first inlet 33 at an inner surface 4 of the outer wear sleeve. The first inlet 33 is positioned to exhaust air from a top chamber 44 of the hammer. The first portion of each flushing channel has a second inlet 35 at an inner surface 4 of the outer wear sleeve. As shown in FIGS. 1 and 5, the second inlet 35 is forward of the first inlet 33 for each flushing channel and is arranged to exhaust air from a bottom chamber 45 of the hammer. The first portion 32 of each flushing channel also comprises an outlet 34 at a forward end 9 of the wall of the outer wear sleeve.

Figure 2:
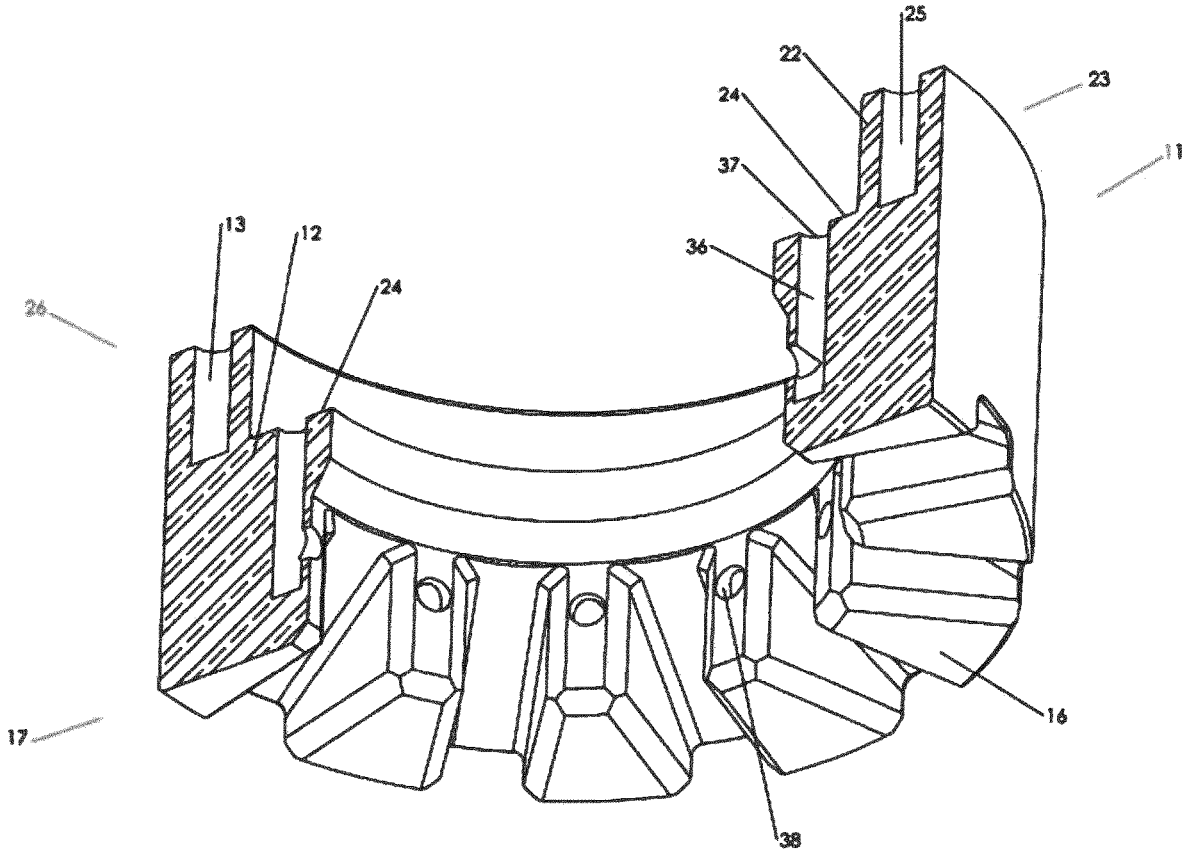
FIG. 2 is a cutaway perspective view of the drive ring of the hammer of FIG. 1.
Figure 3:
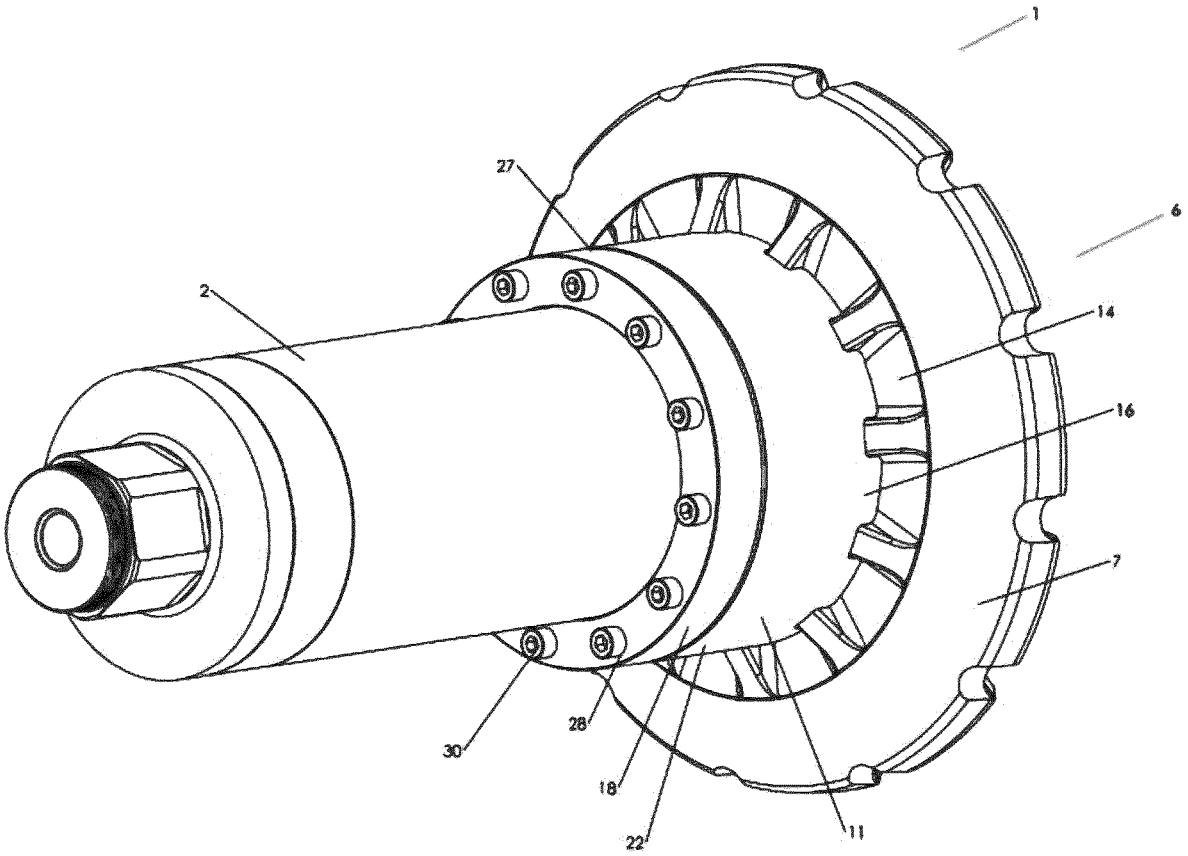
FIG. 3 is a perspective view of the down-the-hole hammer of FIG. 1.

A second portion 36 of each flushing channel 31 extends longitudinally within the wall 12 of the drive ring 11. As shown in FIG. 1, the second portion 36 of each flushing channel is internal to the wall of the drive ring, that is, the second portion of the flushing channel is disposed within and extends longitudinally through the wall of the wear sleeve rather than being disposed within the drive ring itself. The second portion 36 of each flushing channel has an inlet 37 at a rear end of the drive ring, wherein each inlet 37 is arranged to receive the flushing medium from the outlet 34 of the first portion of the corresponding flushing channel. The second portion 36 of each flushing channel has an outlet 38 at an inner surface 39 of the drive ring. As shown in FIG. 2, each outlet 38 is provided in one of the protrusions 16 on the drive ring. In other embodiments, the outlet of the second portion of each flushing channel may be provided at a forward end of the drive ring, for example, in the forward end of one of the protrusions, or between two adjacent protrusions.

A third portion 40 of each flushing channel extends through the head portion 7 of the percussion bit 6 to a cutting face 41 of the bit. The third portion 40 of each flushing channel has an inlet 42 at a head portion of the percussion bit, wherein the inlet is arranged to receive the flushing medium from the outlet 38 of the second portion of the corresponding flushing channel. The third portion 40 of each flushing channel has an outlet 43 in a cutting face of the percussion bit.

In use, the top 44 and bottom 45 chambers are alternately supplied with pressurised air. When the piston is at top of stroke, as shown in FIG. 5, the top chamber 44 is supplied with pressurised air. The inlets 33 of the flushing channels 31 are sealed by the piston 10. The piston is forced down to strike the percussion bit 6. Once the piston moves down (forward) to the position shown in FIG. 1, the inlets 33 are open to exhaust air from the top chamber 44. As shown in FIG. 1, when the piston is in the strike position, the bottom chamber 45 is isolated from the flushing channels, thereby avoiding exposure of the bottom chamber to ambient pressure.

When the piston is in the strike position, pressurised air is supplied to the bottom chamber 45 via supply channels (not shown). As shown in FIG. 1, the bottom chamber is isolated from the flushing channels and is sealed off by the piston 10, the bit 6 and the aligner 29. As a result, the piston 10 lifts and once the forward end of the piston clears the second inlets 35 of the flushing channels, air exhausts from the bottom chamber to the cutting face of the bit. The cycle then repeats with air being alternately supplied to the top and bottom chambers to cause reciprocating movement of the piston within the wear sleeve.

Figure 6:
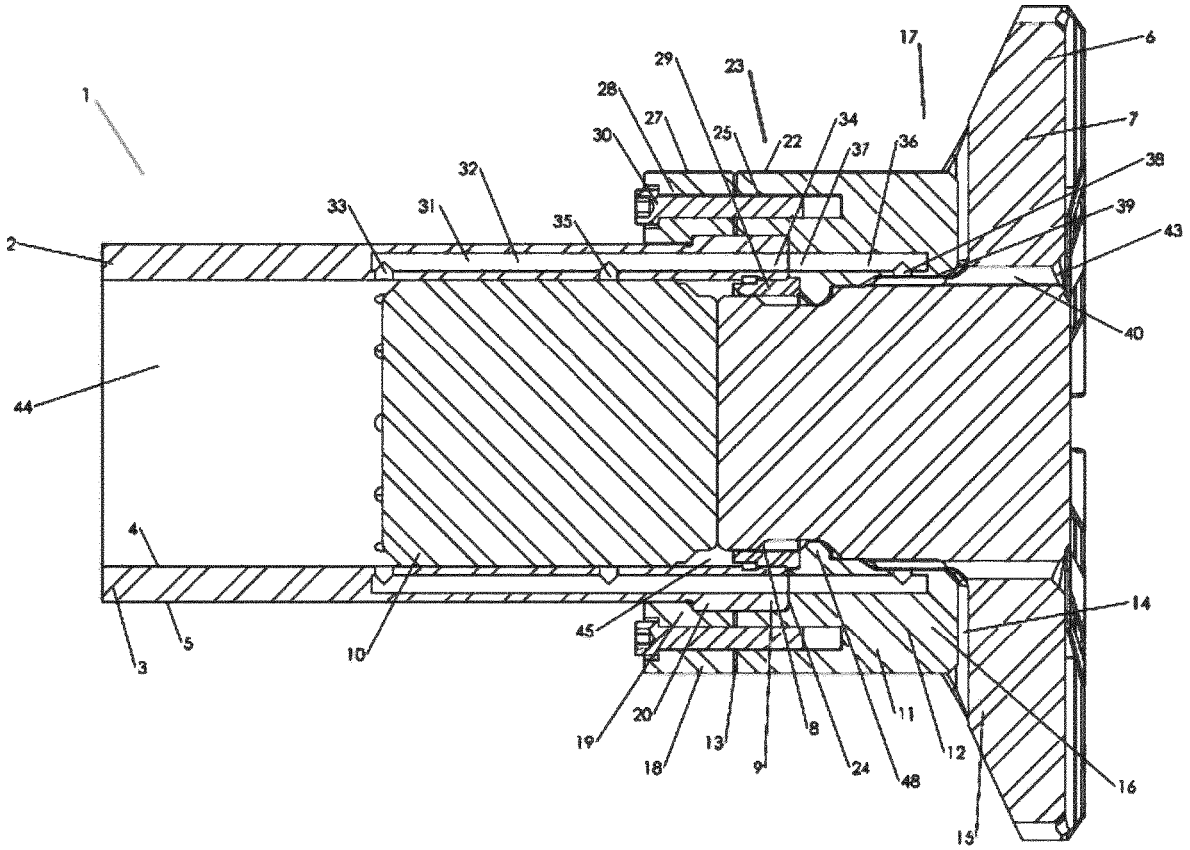
FIG. 6 is a longitudinal cross-section of part of a down-the-hole hammer according to a second embodiment of the invention.
Figure 7:
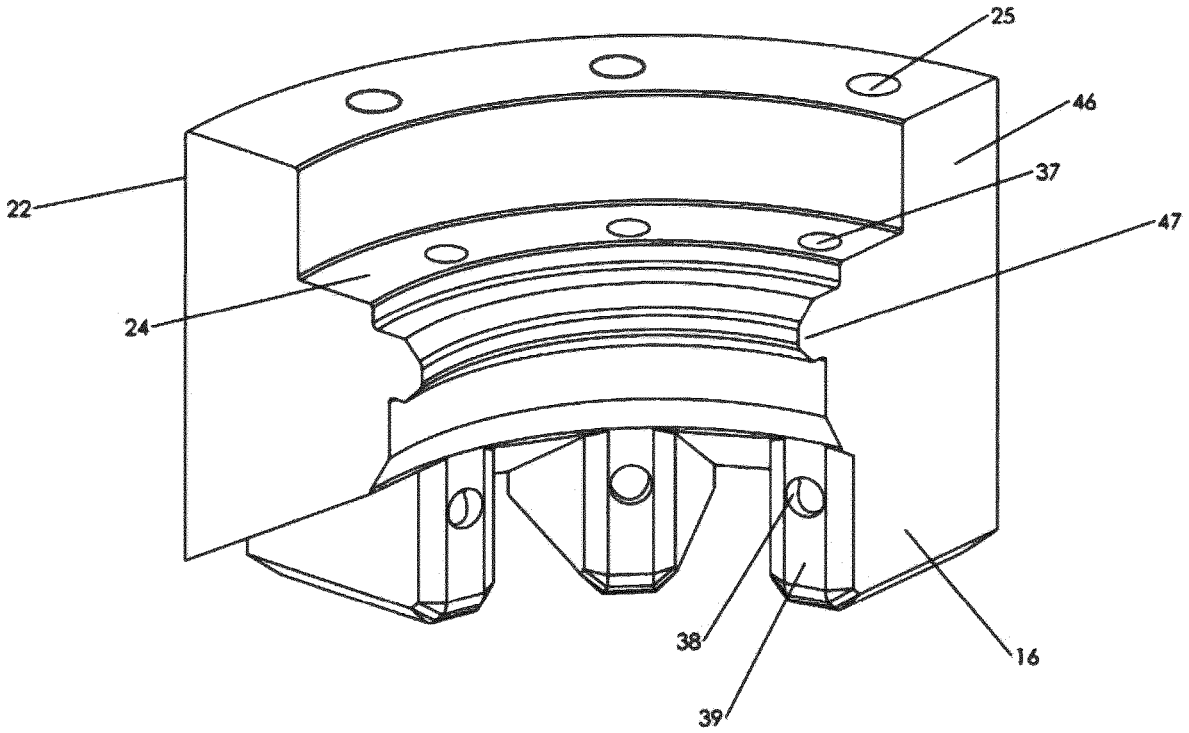
FIG. 7 is a perspective view of a segment of the drive ring of the hammer of FIG. 6.
Figure 8:
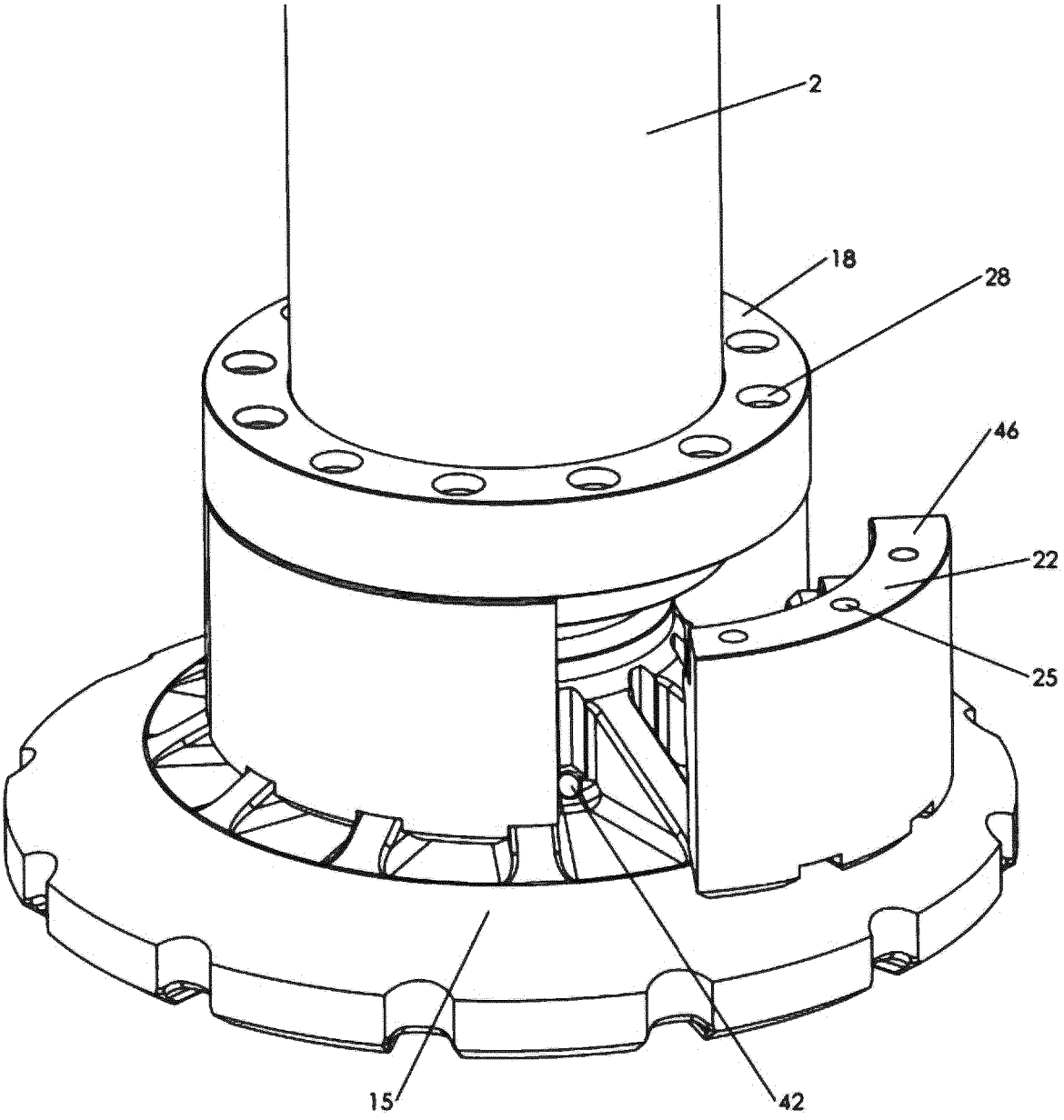
FIG. 8 is an exploded view of some of the components of the hammer of FIG. 6.

A down-the-hole hammer 1 according to a second embodiment of the present invention is illustrated in FIGS. 6 to 8. The hammer 1 of the second embodiment is similar to that of the first embodiment, and like reference numerals are used to refer to like elements. The second embodiment differs from the first embodiment in that the drive ring 11 comprises a plurality of part annular segments 46, as shown in FIGS. 7 and 8. Each segment 46 is provided with three protrusions 16. In other embodiments, each segment may be provided with a greater or lesser number of protrusions. Instead of a bit retaining ring, each segment 46 is formed with a shoulder 47, so that when the drive ring 11 is assembled, a continuous bit retaining shoulder 48 engages with the bit retaining shoulder 8 on the percussion bit to retain the bit in the hammer.

Figure 9:
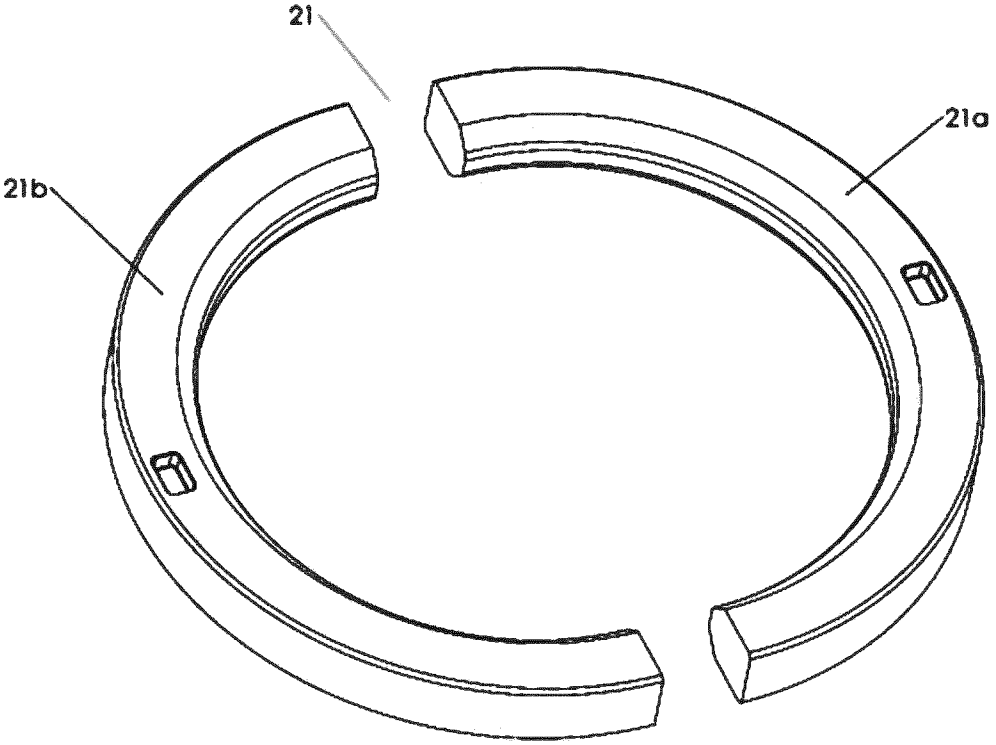
FIG. 9 is an exploded view of a bit retaining ring for use in the down-the-hole hammer of FIG. 1.
Figure 10B:
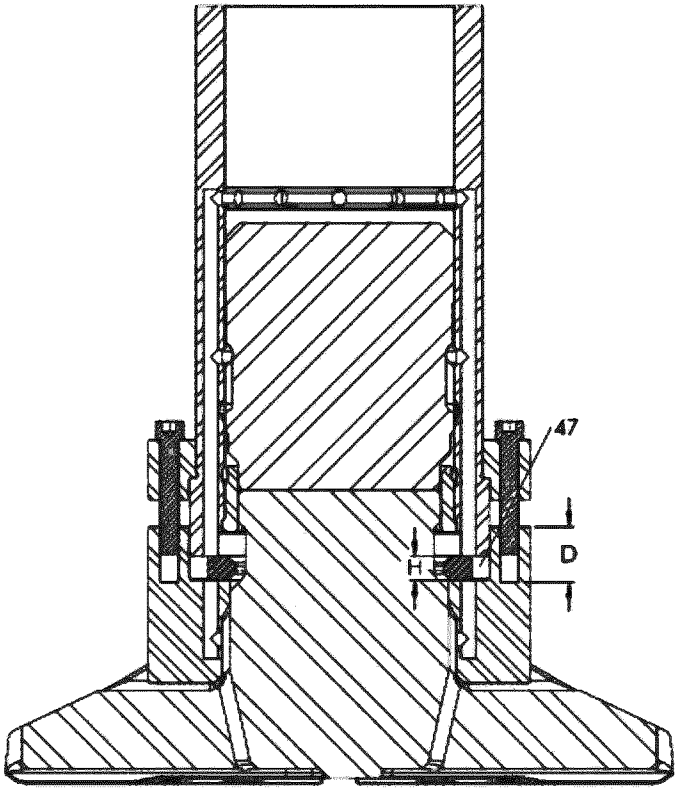
FIGS. 10A to 10D are longitudinal cross-sections of the down-the-hole hammer of FIG. 1, showing removal of the bit from the hammer.
Figure 10A:
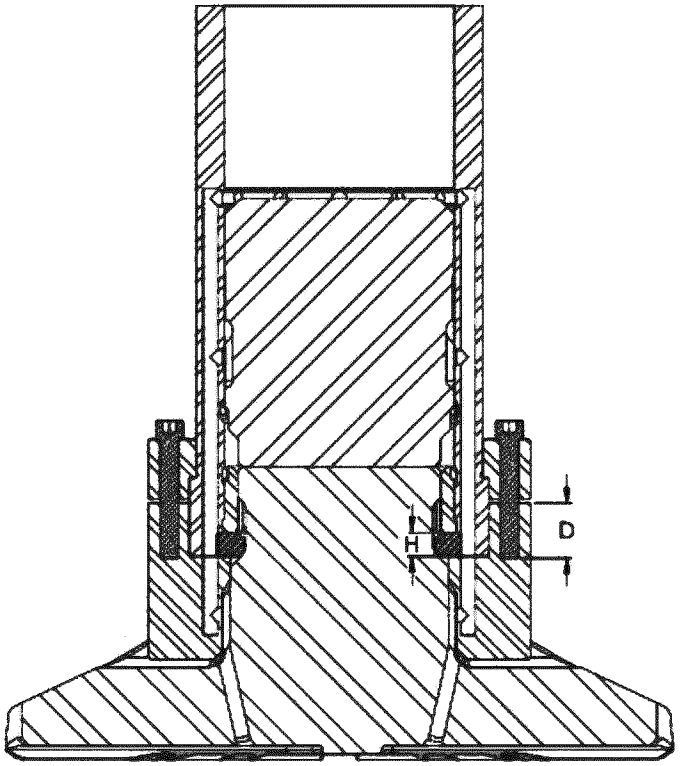

As shown in FIG. 9, the bit retaining ring 21 of the embodiment shown in FIGS. 1 to 5 may be provided as two part-annular bit retaining portions or halves 21*a*, 21*b*. In alternate embodiments, the ring 21 may be split into a greater number of portions. As can be seen in FIG. 1 and as indicated in FIG. 10A, the depth D of the holes 25 in the collar 22 of the drive ring 11 is greater than a height H of the bit retaining ring. This allows the percussion bit 6 to be removed from the hammer without removing the drive ring 11. This may be achieved by withdrawing the bolts 30 from the holes 25 by a distance greater than or equal to the height H of the bit retaining ring portions but less than the depth D of the holes. As shown in FIG. 10B, the outer wear sleeve 2 can then be moved away from the percussion bit 6, for example by lifting the hammer, thereby creating an annular space 47 between the forward end 9 of the wear sleeve and the internal shoulder 24 of the drive ring. The bolts 30 are still engaged in the holes 25 and so the drive ring 11 is still retained in the hammer.

Figure 10D:
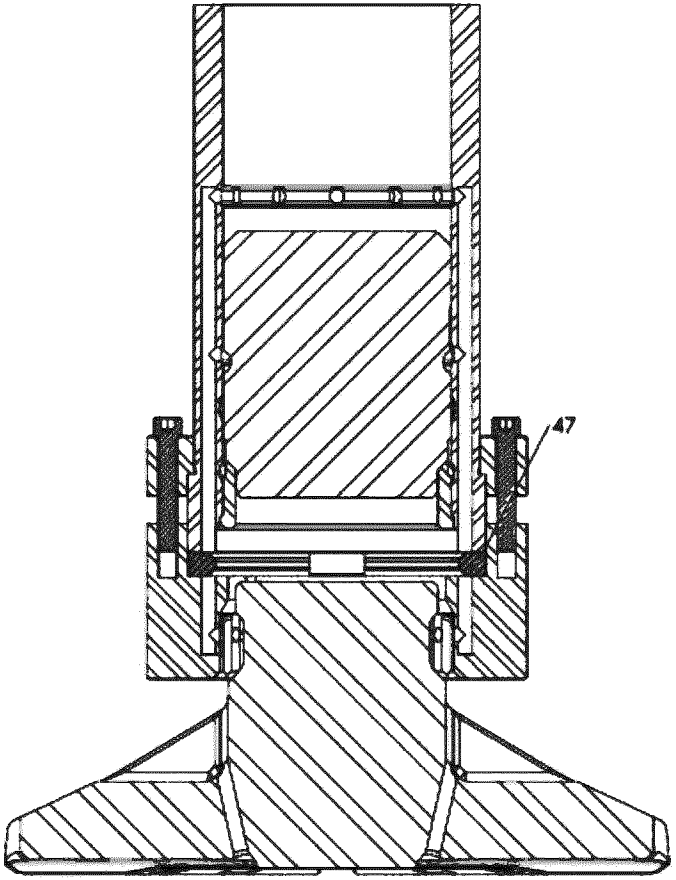
Figure 10C:
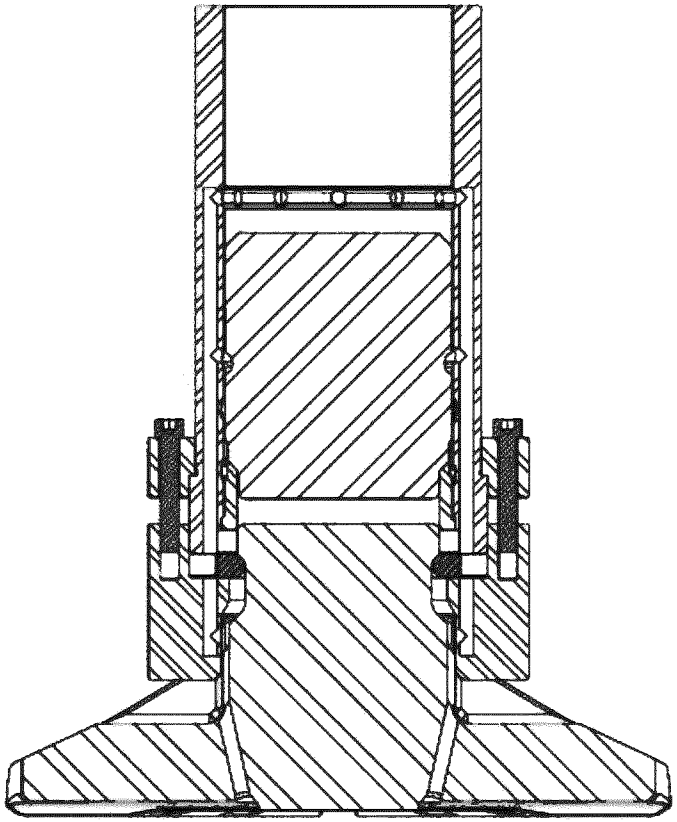
Figure 11:
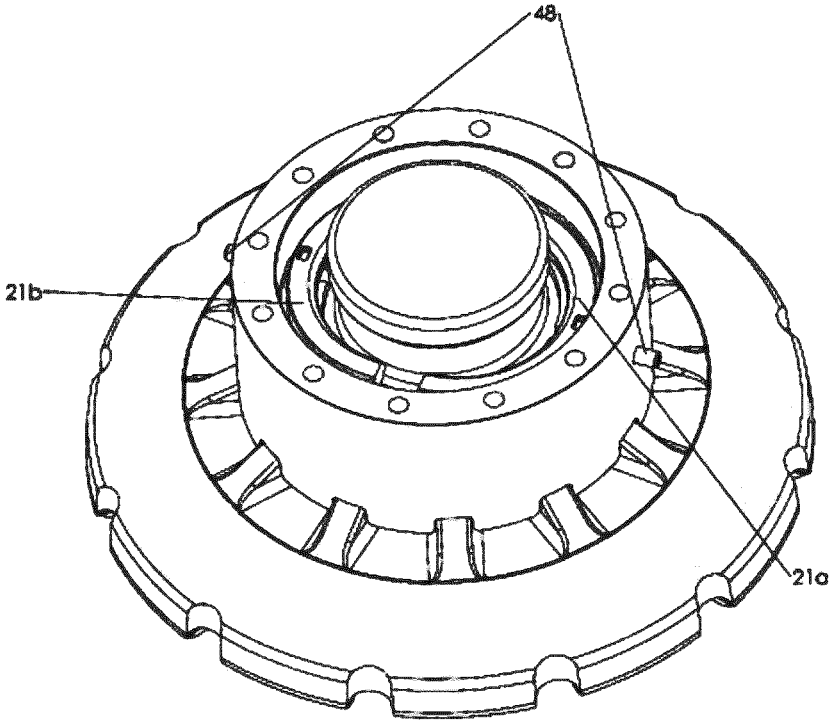
FIG. 11 is a perspective view of the percussion bit and drive ring of the hammer of FIG. 1.

As shown in FIG. 10C, as the hammer is lifted further, the percussion bit 6 drops out of the hammer, so that the bit retaining portion of the bit engages the halves 21*a*, 21*b* of the bit retaining ring 21. The mass of the bit causes the halves to move in a radially outward direction into the annular space 47 such that they no longer retain the percussion bit in the hammer, as shown in FIG. 10D. This allows the bit to be removed or replaced without removing the drive ring from the hammer. A new bit may be inserted and the bit retaining ring halves 21*a*, 21*b* returned to the bit retaining position by way of pins 48, shown in FIG. 11, extending through the drive ring 11 and arranged to engage the halves 21*a*, 21*b*. In an alternate embodiment, a resilient o-ring may be provided around the bit retaining ring halves 21*a*, 21*b* to bias the halves inwardly such that they return to their original bit retaining position when the bit is removed. Once the new bit has been inserted, the hammer is re-assembled by moving the wear sleeve towards the bit and inserting the bolts fully into the holes.

Figure 12:
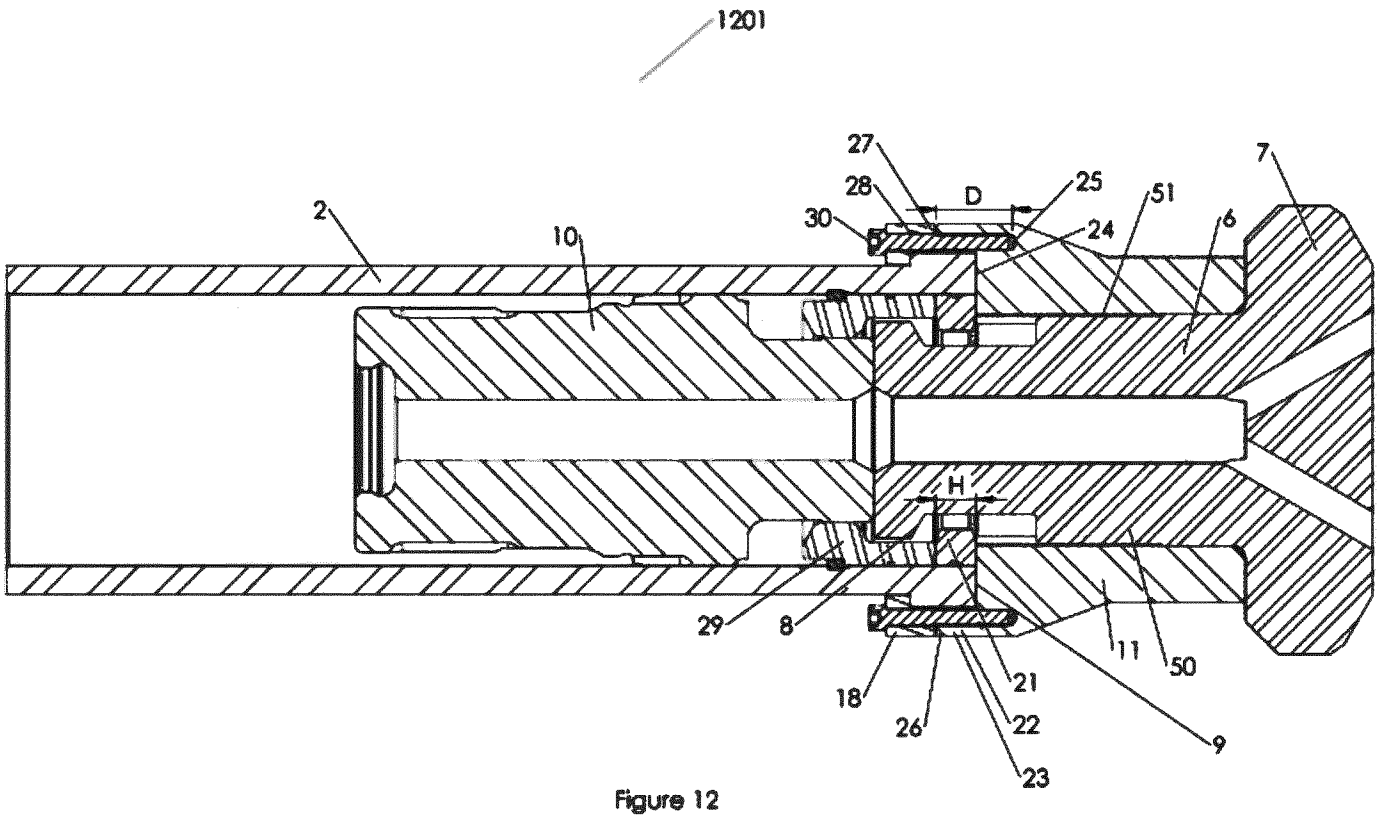
FIG. 12 is a longitudinal cross-section of a down-the-hole hammer according to an embodiment of the second aspect of the invention.

A down-the-hole hammer according to an embodiment of a second aspect of the invention is illustrated in FIG. 12. The hammer 1201 comprises an outer wear sleeve 2 and a percussion bit 6 having a head portion 7 and a bit retaining shoulder 8 located at a forward end 9 of the outer wear sleeve. The hammer 1201 also comprises a sliding piston 10 mounted for reciprocating movement within the outer wear sleeve to strike the percussion bit.

The hammer further comprises a drive ring 11 which has an annular collar 22 provided at a rear end 23 thereof, arranged to receive the forward end 9 of the wear sleeve such that the forward end of the wear sleeve abuts an internal shoulder 24 of the drive ring. A plurality of internally screw-threaded holes 25 are provided in a rear end 26 of the collar, and the rear end of the collar is arranged to abut a forward end 27 of a flange 18. A plurality of through holes 28 are provided in the flange. Each through hole corresponds to one of the plurality of holes in the collar. A bolt 30 is inserted into each through hole 28 and screwed into the corresponding hole 25 in the collar to connect the drive ring to the wear sleeve and thus to the drive means of the percussion drill tool. The clamping effect of this bolted arrangement also holds the bit retaining ring 21 in place between the drive ring 11 and an aligner 29. Splines 50 on the drive ring engage with complementary splines 51 on the percussion bit to transfer rotational drive to the bit.

As shown in FIG. 9, the bit retaining ring 21 is provided as two part-annular bit retaining ring halves 21*a*, 21*b*. In other embodiments, the ring may comprise a larger number of part-annular portions. The depth D of the holes 25 in the collar 22 of the drive ring is greater than a height H of the bit retaining portions such that the percussion bit is removable from the drill tool by withdrawing the bolts 30 from the holes 25 by a distance greater than or equal to the height of the bit retaining portions 21*a*, 21*b* but less than the depth of the holes such that when the outer wear sleeve 2 is moved away from the percussion bit 6, an annular space is formed between the forward end of the wear sleeve and the internal shoulder of the drive ring, into which the bit retaining portions are moveable in a radially outward direction such that they no longer retain the percussion bit in the drill tool. The percussion bit 6 can thus be removed from the hammer 1201 without removing the drive ring 11, in a similar fashion to that described above with reference to FIGS. 10A to 10D.

The words "comprises/comprising" and the words "having/including" when used herein with reference to the present invention are used to specify the presence of stated features, integers, steps or components but does not preclude the presence or addition of one or more other features, integers, steps, components or groups thereof.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

The invention claimed is:

1. A fluid-operated percussion drill tool comprising:

an outer wear sleeve comprising a substantially cylindrical wall and having inner and outer surfaces;

a percussion bit having a head portion and a bit retaining portion and located at a forward end of the outer wear sleeve;

a sliding piston mounted for reciprocating movement within the outer wear sleeve to strike the percussion bit;

a drive ring having a substantially cylindrical wall and comprising connection means adapted for connecting the drive ring to a drive means of the fluid-operated percussion drill tool;

at least one flushing channel to provide a fluid path to the cutting face of the bit for a flushing medium, characterised in that a first portion of the at least one flushing channel is disposed within and extends longitudinally through the wall of the wear sleeve, a second portion of the at least one flushing channel extends longitudinally within the wall of the drive ring and a third portion of the at least one flushing channel extends through the head portion of the percussion bit to the cutting face of the bit.

2. A fluid-operated percussion drill tool as claimed in claim 1, wherein the first portion of the or each flushing channel has a first inlet at an inner surface of the outer wear sleeve and an outlet at a forward end of the wall of the outer wear sleeve.

3. A fluid-operated percussion drill tool as claimed in claim 2, wherein the first portion of the or each flushing channel has a second inlet at an inner surface of the outer wear sleeve, wherein the second inlet is at a different longitudinal position along the wear sleeve than the first inlet.

4. A fluid-operated percussion drill tool as claimed in claim 3, wherein the second inlet is forward of the first inlet.

5. A fluid-operated percussion drill tool as claimed in claim 2, wherein the second portion of the or each flushing channel has an inlet at a rear end of the drive ring and an outlet, wherein the inlet is arranged to receive the flushing medium from the outlet of the first portion of the flushing channel.

6. A fluid-operated percussion drill tool as claimed in claim 5, wherein the outlet of the second portion of the or each flushing channel is provided at an inner surface of the drive ring.

7. A fluid-operated percussion drill tool as claimed in claim 5, wherein the outlet of the second portion of the or each flushing channel is provided at a forward end of the drive ring.

8. A fluid-operated percussion drill tool as claimed in claim 5, wherein the third portion of the or each flushing channel has an inlet at a head portion of the percussion bit and an outlet in a cutting face of the percussion bit, wherein the inlet is arranged to receive the flushing medium from the outlet of the second portion of the flushing channel.

9. A fluid-operated percussion drill tool as claimed in claim 1, further comprising engagement means on the percussion bit engageable with complementary engagement means on the drive ring whereby rotational drive from the drive ring may be transmitted to the percussion bit.

10. A fluid-operated percussion drill tool as claimed in claim 9, wherein the engagement means is provided on the head portion of the percussion bit.

11. A fluid-operated percussion drill tool as claimed in claim 10, wherein the engagement means on the head portion of the percussion bit comprises a plurality of recesses and the complementary engagement means on the drive ring comprises a corresponding plurality of protrusions at a forward end thereof, whereby each protrusion is received within a corresponding recess to transmit rotational drive from the drive ring to the percussion bit.

12. A fluid-operated percussion drill tool as claimed in claim 11 wherein the drive ring comprises a plurality of separable part-annular drive dog segments and each drive dog segment comprises one or more of the plurality of protrusions.

13. A fluid-operated percussion drill tool as claimed in claim 11, wherein the second portion of the or each flushing channel has an outlet in one of the protrusions on the drive ring.

14. A fluid-operated percussion drill tool as claimed in claim 11, wherein the second portion of the or each flushing channel has an outlet between two adjacent protrusions on the drive ring.

15. A fluid-operated percussion drill tool as claimed in claim 1, further comprising an annular flange arranged around the outer wear sleeve at a forward end thereof.

16. A fluid-operated percussion drill tool as claimed in claim 15, wherein the flange is restrained from forward movement relative to the wear sleeve by engagement of an internal shoulder provided on the flange with an external shoulder provided at a forward end of the wear sleeve.

17. A fluid-operated percussion drill tool as claimed in claim 15, wherein the connection means of the drive ring comprises an annular collar provided at a rear end of the drive ring, arranged to receive a forward end of the wear sleeve such that a forward end of the wear sleeve abuts an internal shoulder of the drive ring.

18. A fluid-operated percussion drill tool as claimed in claim 17, further comprising a plurality of holes provided in a rear end of the collar, and the rear end of the collar is arranged to abut a forward end of the flange.

19. A fluid-operated percussion drill tool as claimed in claim 18, wherein the flange comprises a plurality of through holes provided therein, and wherein each through hole corresponds to one of the plurality of holes in the collar, and wherein each through hole and corresponding hole in the collar is configured to receive a fastener to connect the drive ring to a drive means of the percussion drill tool.

20. A fluid-operated percussion drill tool comprising:

an outer wear sleeve comprising a substantially cylindrical wall and having inner and outer surfaces;

a percussion bit having a head portion and a bit retaining portion and located at a forward end of the outer wear sleeve;

a sliding piston mounted for reciprocating movement within the outer wear sleeve to strike the percussion bit;

a drive ring having a substantially cylindrical wall and comprising connection means adapted for connecting the drive ring to a drive means of the fluid-operated percussion drill tool; and an annular flange arranged around the outer wear sleeve at a forward end thereof, wherein the flange comprises a plurality of through holes provided therein and is restrained from forward movement relative to the wear sleeve by engagement of an internal shoulder provided on the flange with an external shoulder provided at a forward end of the wear sleeve; and wherein the connection means of the drive ring comprises an annular collar provided at a rear end of the drive ring, the collar comprising a plurality of holes provided in a rear end thereof, wherein each hole corresponds to one of the plurality of through holes in the flange, the collar arranged to receive a forward end of the wear sleeve such that a forward end of the wear sleeve abuts an internal shoulder of the drive ring and the rear end of the collar is arranged to abut a forward end of the flange and wherein each through hole and corresponding hole in the collar is configured to receive a fastener to connect the drive ring to a drive means of the percussion drill tool.

21. A fluid-operated percussion drill tool as claimed in claim 20, further comprising a bit retaining ring arranged for engagement with the bit retaining portion of the percussion bit to retain the percussion bit in the drill tool, wherein the bit retaining ring is clamped between the drive ring and an aligner by the engagement of the fasteners with the drive ring.

22. A fluid-operated percussion drill tool as claimed in claim 21, wherein the bit retaining ring is provided as a plurality of part-annular bit retaining portions; and wherein the depth of the holes in the collar of the drive ring is greater than a height of the bit retaining portions such that the percussion bit is removable from the drill tool by withdrawing the fasteners from the holes by a distance greater than or equal to the height of the bit retaining portions but less than the depth of the holes such that when the outer wear sleeve is moved away from the percussion bit, an annular space is formed between the forward end of the wear sleeve and the internal shoulder of the drive ring, into which the bit retaining portions are moveable in a radially outward direction such that they no longer retain the percussion bit in the drill tool.

23. A fluid-operated percussion drill tool as claimed in claim 22, further comprising an O-ring arranged around the bit retaining portions.

24. A fluid operated percussion drill tool as claimed in claim 22, further comprising a plurality of pins extending through the drive ring and arranged to engage the bit retaining portions.

25. A method for removing a percussion drill bit from a fluid-operated percussion drill tool as claimed in claim 22, comprising:

withdrawing the fasteners from the holes by a distance greater than or equal to the height of the bit retaining portions but less than the depth of the holes;

moving the outer wear sleeve and the drive ring apart relative to one another to create an annular space between the forward end of the wear sleeve and the internal shoulder of the drive ring; and moving the drill tool and the percussion drill bit apart relative to one another, such that the bit retaining portion of the percussion bit causes the bit retaining portions of the bit retaining ring to move in a radially outward direction into the annular space.

26. A method as claimed in claim 25, wherein the method is further for replacing the percussion drill bit, the method further comprising:

inserting a percussion bit into the distal end of the percussion drill tool;

moving the bit retaining portions of the bit retaining ring in a radially inward direction by actuating a plurality of pins extending through the drive ring and arranged to engage the bit retaining portions; and moving the outerwear sleeve towards the percussion bit and re-inserting the fasteners in the holes.

* * * * *